United States Patent [19]

Thibault et al.

[11] Patent Number: 4,603,652

[45] Date of Patent: Aug. 5, 1986

[54] DEVICE FOR FASTENING FLAGS OR THE LIKE TO THEIR STAFF OR THE LIKE AVOIDING WINDING THEREOF

[76] Inventors: Blandine Thibault; Delphine Thibault, both of 5, rue Alfred Roll, 75017 Paris, France

[21] Appl. No.: 753,080

[22] Filed: Jul. 9, 1985

[30] Foreign Application Priority Data

Jul. 9, 1984 [FR] France ..... 84 10886

[51] Int. Cl.[4] ..... G09F 17/00

[52] U.S. Cl. ..... 116/174

[58] Field of Search ..... 116/173, 174, 175; 52/720, 103, 104; 40/218

[56] References Cited

U.S. PATENT DOCUMENTS

| | | | |
|---|---|---|---|
| 492,229 | 2/1893 | Pirer | 116/175 |
| 982,645 | 1/1911 | Suhr | 116/174 |
| 2,225,103 | 12/1940 | Einermann | 116/173 |
| 2,368,783 | 2/1945 | Schillinger | 116/174 |
| 3,417,732 | 12/1968 | Platt, Jr. | 116/173 |

FOREIGN PATENT DOCUMENTS

| | | | |
|---|---|---|---|
| 486679 | 11/1929 | Fed. Rep. of Germany | 116/173 |

*Primary Examiner*—Charles Frankfort
*Assistant Examiner*—Patrick R. Scanlon
*Attorney, Agent, or Firm*—Millen & White

[57] ABSTRACT

This invention relates to a device for fastening a flag on a staff via a sleeve coaxial to the staff mounted to rotate freely on the staff, the device comprising a rod having two ends, a first end being connected to the sleeve so that the rod extends, at least partially, in a plane substantially transverse to the sleeve, the second end of the rod being remote from the sleeve and connected to the flag, whereby the torque exerted by the flag on the sleeve under the effect of the wind and/or of the weight of the flag is increased.

3 Claims, 12 Drawing Figures

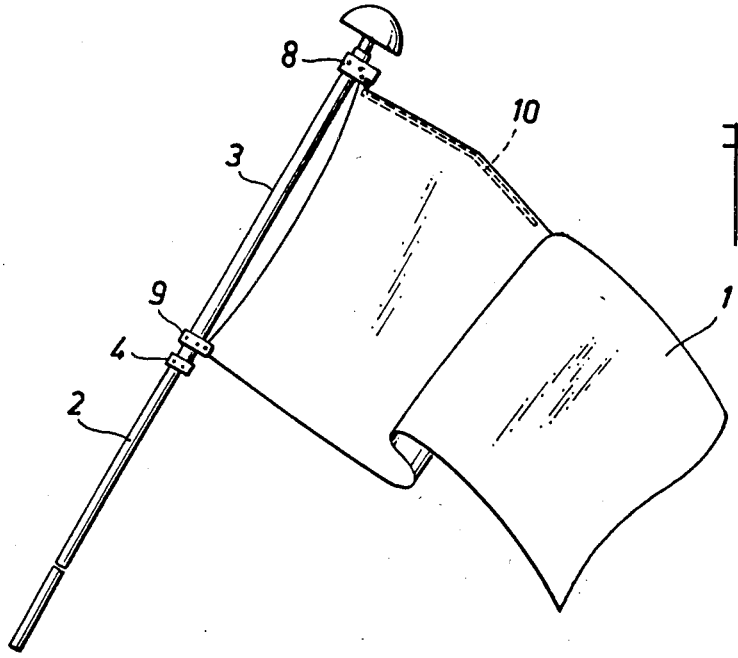
Fig. 1
Fig. 3A
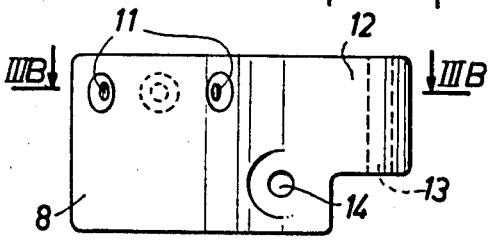
Fig. 4A
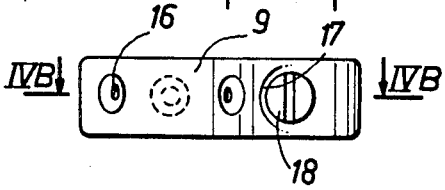
Fig. 3B
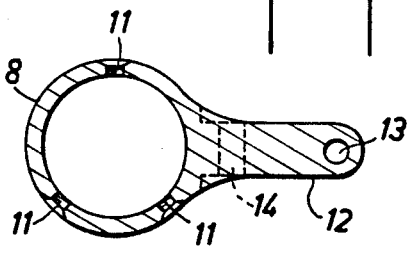
Fig. 4B
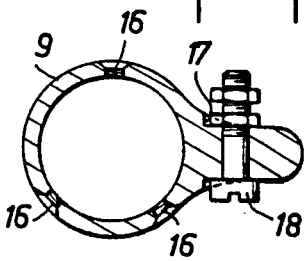

DEVICE FOR FASTENING FLAGS OR THE LIKE TO THEIR STAFF OR THE LIKE AVOIDING WINDING THEREOF

The present invention relates to the fastening of flags, banderoles, banners, streamers, etc . . . on a substantially rectilinear support such as a pole, staff, halyard, rope, etc. . . .

Out of doors, and therefore at the mercy of the vagaries of the wind, hoisted flags frequently wind around their staff.

The same applies to marine flags at the top of their mast.

This results in a somewhat sorry sight, contrary to the desired effect. The colours do not float in the wind, or are partially hampered.

In a period of calm, the sight remains just as sad, if not more so, if no one unfurls the flags.

Such supervision cannot be assured constantly, all the more so as access to flags at the top of poles is often difficult or dangerous (high ridge board; halyard stopped on a catch located fairly high up to avoid theft and requiring a ladder to reach it), or as the oblique staffs installed in front of windows or balconies along the facades of buildings are often difficult to manoeuvre, because the person responsible for this work must lean out into space.

U.S. Pat. No. 3,595,202 has already proposed fixing the flag to the staff via at least one sleeve coaxial to the staff mounted to rotate freely thereon, or by at least one rotating ring, so that, under the effect of the wind and/or of the weight of the flag, the flag exerts on the sleeve a rotating torque tending to rotate it and avoid the flag winding therearound. Although the known devices have, in principle, brought some improvements, to Applicants' knowledge, they have not been developed commercially, doubtlessly due to their relatively complex construction and the insufficient results that they afforded.

It is an object of the present invention to propose a device for fastening a flag, with the interposition of a rotating sleeve, which allows the flag to move with considerable suppleness in the wind and is very efficient, enabling the flag to make complete revolutions without wrapping around the staff and without being hindered by the device.

The invention attains its purpose thanks to a device which comprises a rod having two ends, a first end being connected to the sleeve so that the rod extends, at least partially, in a plane substantially transverse to the sleeve, the second end of the rod being remote from the sleeve and connected to the flag, whereby the torque exerted by the flag on the sleeve under the effect of the wind and/or of the weight of the flag is increased. Such an increase in the torque enables the rotating sleeve veritably to perform its role.

Under the effect of the wind, if the flag makes a complete revolution, in one direction or the other about the staff, the support itself pivots with the flag, and the flag does not wind on the staff.

In this way, the flag is virtually always unfurled.

If, by an effect of turbulence, the flag drops onto its support without, momentarily, being influenced by the movements of the air, it will nonetheless unfurl itself again very shortly.

In fact, as the weight of the dropped flag lying on either side of the staff is not balanced for long, it will entrain the flag on one side or the other, and will cause it to unwind, all the more so as the staff is inclined.

In order that the flag appears completely free to float depending on the wind, as in a conventional fastening or fixing system, the rod increasing the torque effect is itself mounted to rotate virtually freely on the pivoting sleeve, with a pivot axis fixed in relation to the sleeve and advantageously parallel to the staff.

Rotation of this rod is in fact hampered only over about 55° (in a preferred embodiment), angle from which the sleeve, actuated by the rod which forms a lever arm thereon, pivots on itself and releases the rod and flag again.

The flag therefore makes multiple complete or partial loops without being hampered.

It floats vigourously or slackly, depending on the weather, virtually without ever being jibed.

This system of fastening may be applied to flags, streamers, banners, etc . . . , whether they be supported by a vertical, horizontal, oblique or concave rope, or supported by a rigid staff or pole in vertical or oblique position.

The pivot axis of the rod may also be a radial axis with respect to the staff. In that case, it is advantageous if the rod is curved in its end part remote from the sleeve: the curved part pivots about an axis merged with that part of the rod extending in the plane substantially transverse to the sleeve.

It is advantageous if the rod benefits from the two pivot axes, this increasing its possibilities of movement.

The invention will be more readily understood on reading the following description with reference to the accompanying drawings, in which:

FIG. 1 schematically shows a flag mounted on an oblique staff by means of a first embodiment of the fastening device.

FIGS. 3A and 3B are side and section views of the upper ring of the device of FIG. 2.

FIGS. 4A and 4B are side and transverse section views of the lower ring of the device of FIG. 2.

Figure 2:
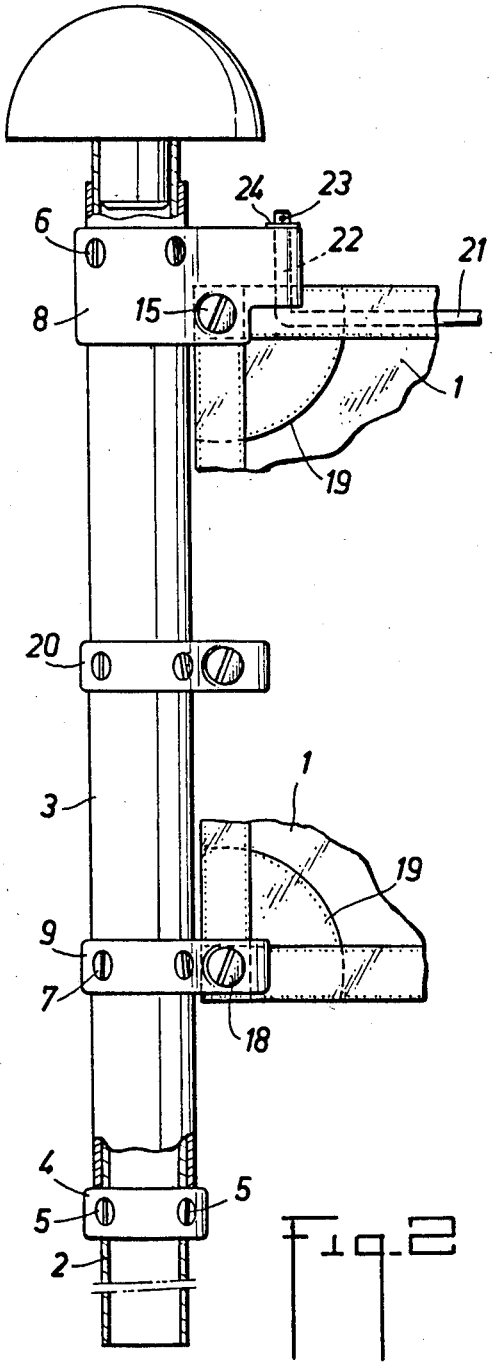
FIG. 2 is a detailed view of the device of FIG. 1.

Referring now to the drawings, the preferred embodiment (FIGS. 1 and 2) of the device for fastening the flag 1 on the staff 2 essentially comprises a pivoting sleeve 3 fitted on the staff 2, retained in its lower part by a stop ring 4 clamped by screws 5 on the staff 2. On sleeve 3 are fixed, by means of locking screws 6 and 7, an upper ring 8 and a lower ring 9 adapted to fasten the corners of the flag 1 and to increase the rotating torque. To this latter end, the upper ring 8 serves as pivot for a torque rod 10 fitted in a hem in the upper edge of the flag. To that end (FIGS. 3A and 3B),the ring 8 comprises, in addition to a part for fixation on the sleeve, in the form of a ring provided with screw holes 11 with notched cup, a radial extension 12 in which is provided the passage adapted for the pivoting part of the rod 10. The ring 8 also comprises a sunk hole 14 for the bolt 15 for fastening the upper corner of the flag, with interposition of a washer.

The lower ring 9 also comprises (FIGS. 4A, 4B) holes 16 for fixing screws, as well as on a radial extension part, a sunk hole 17 for the bolt 18 for fastening the lower corner of the flag.

The corners of the flag which are fastened are reinforced by eyelets and stiffenings sewn at 19 (FIG. 2).

One or more intermediate rings 20 may be provided for fastening the flag (FIG. 2), identical to the lower ring 9.

The torque rod 10 comprises an extension part 21 placed substantially in a plane transverse to the staff 2 (radial plane) and a pivot part 22 rotating in the passage 13 of the upper ring 8.

The pivot part 22 makes a substantially right angle with the extension part 21. It is blocked in the passage 13 by a pin 23 (or by the end of pivot 22 being crushed), with the interposition of a washer 24.

The extension part 21 of the rod 10 is advantageously extended by a rod 25 capable of pivoting in the extension part 21 made in a hollow tube to this end. The rod 25 is maintained in place thanks to crushed parts 26 and 27 (with the interposition of washers 28, 29).

The terminal part A of the rod 25 is bent at B with respect to the rest of the rod, and the end C of the rod is curved to promote threading of the rod 10 in the upper hem of the flag 1, and to avoid tears.

The fastening device which has just been described may therefore make three types of movements depending on the stresses exerted thereon via the flag: the rod 25, A may pivot, perpendicularly to the staff, in the extension part 21 of the rod; part 21 of the rod may pivot about pivot 22, parallel to the staff; finally, the whole sleeve 3 may pivot about the staff. These three movements combine, depending on the nature of the forces coming into play and the resistances to the movement of the different members, to give the flag optimum mobility and to enable it to make loops without winding around the staff.

Figure 6:
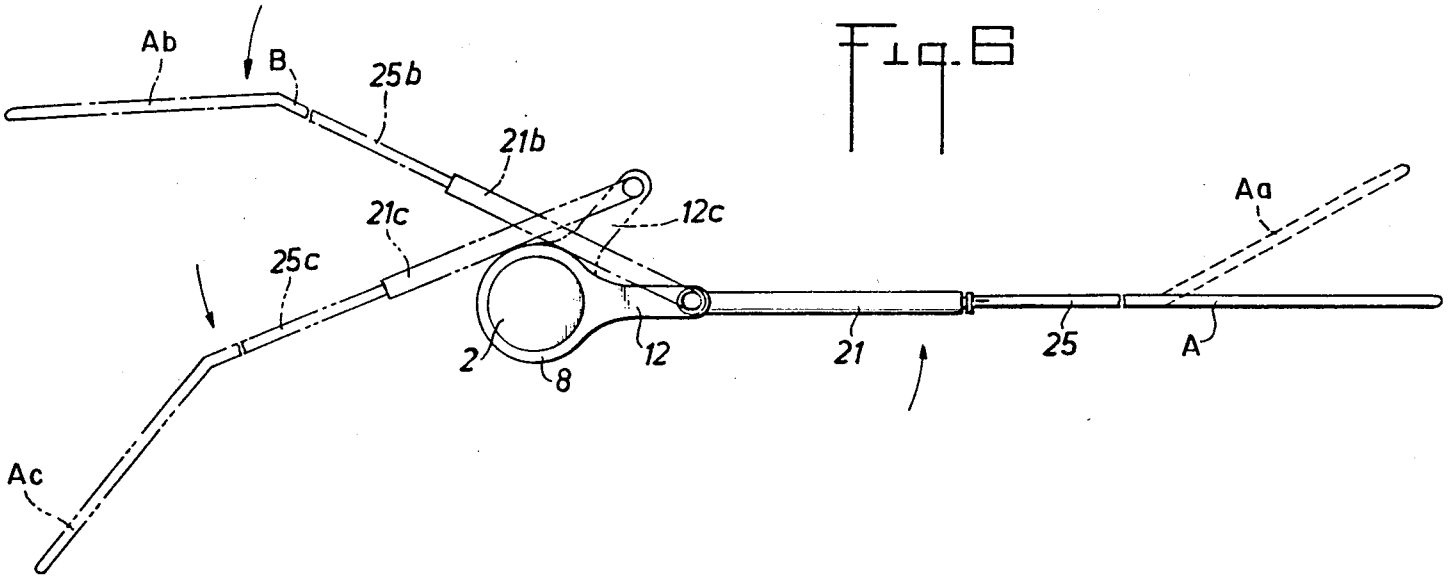
FIG. 6 is a diagram showing different positions of the ring and of the rod depending on the stresses exerted thereon.

These three movements are shown in FIG. 6. It is assumed that the starting position of ring and rod is as shown in solid lines and referenced 8, 12, 21, 25, A, the whole flag being in a plane radial to the staff 2, and it is admitted that the, stresses of the wind may be represented by rotating forces in the trigonometrical sense.

The first movement causes the terminal part 26 of the rod to pivot towards a position Aa.

The second movement causes the assembly 21, 25, Aa to pivot towards a position **21*b*, 25*b*, Ab in which the extension part 21*b* of the rod comes into abutment against the ring 8 (or against the sleeve 3 depending on the shape of the ring 8**).

The third movement causes the assembly 12, **21*b*, 25*b*, Ab to pivot towards a position 12*c*, 21*c*, 25*c***, Ac.

It is obvious that these movements are composed together, as well as with the movements in opposite direction, as a function of the development in time of the forces coming into play (the wind and, when the staff is not vertical, the inherent weight of the flag).

The device according to the invention is adaptable to an assembly whereby the flag must be able to be hoisted and lowered as desired.

Figure 7:
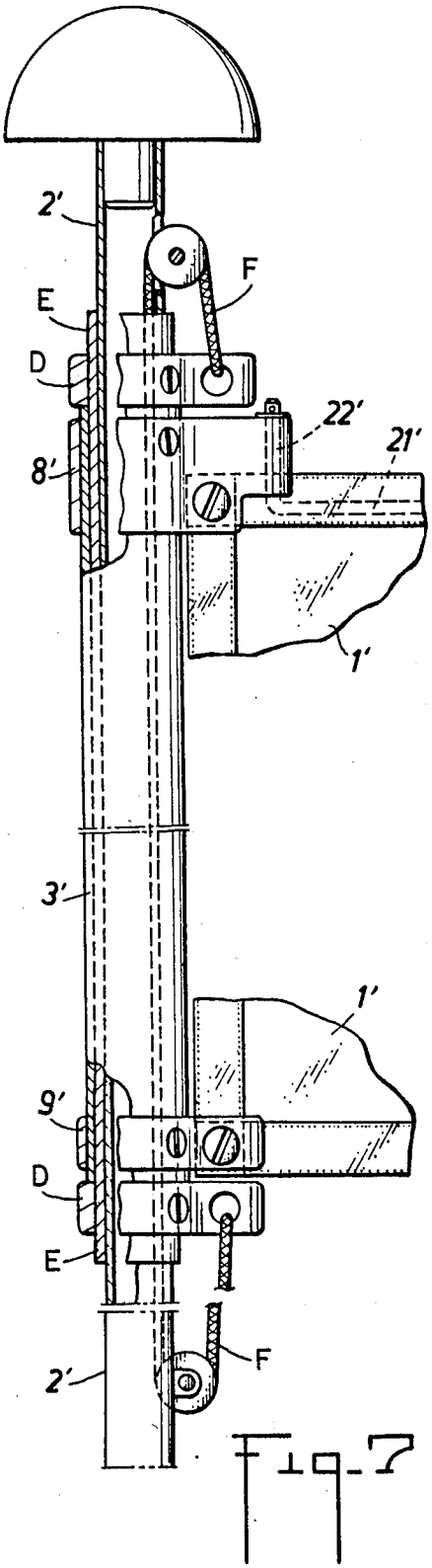
FIG. 7 is a detailed view, similar to FIG. 2, of the invention applied to a sliding sleeve.
Figure 5:
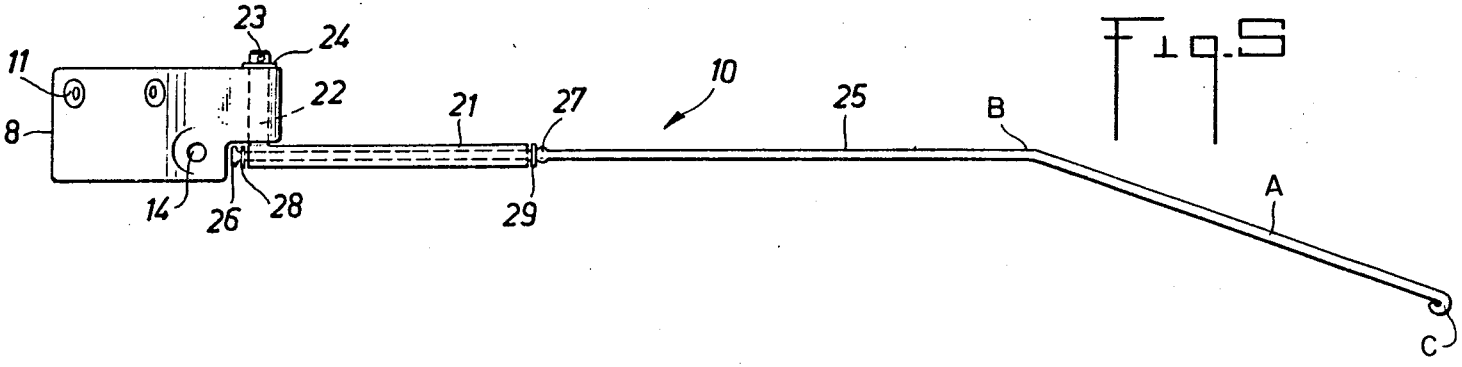
FIG. 5 is a side view of the rod of the device of FIG. 2.

In this assembly, shown in FIG. 7, elements similar to those of FIG. 2 bear the same references, to which the prime sign has been added. The pivoting sleeve 3' is mounted on the staff 2' via a sliding sleeve E on which are fixed rings D for fastening the ends of a rope F guided by bottom and top pulleys. By manoeuvring the rope, the sleeve F, and consequently the flag, may be made to slide along the staff, which flag rotates freely as in the preceding embodiment.

Figure 8:
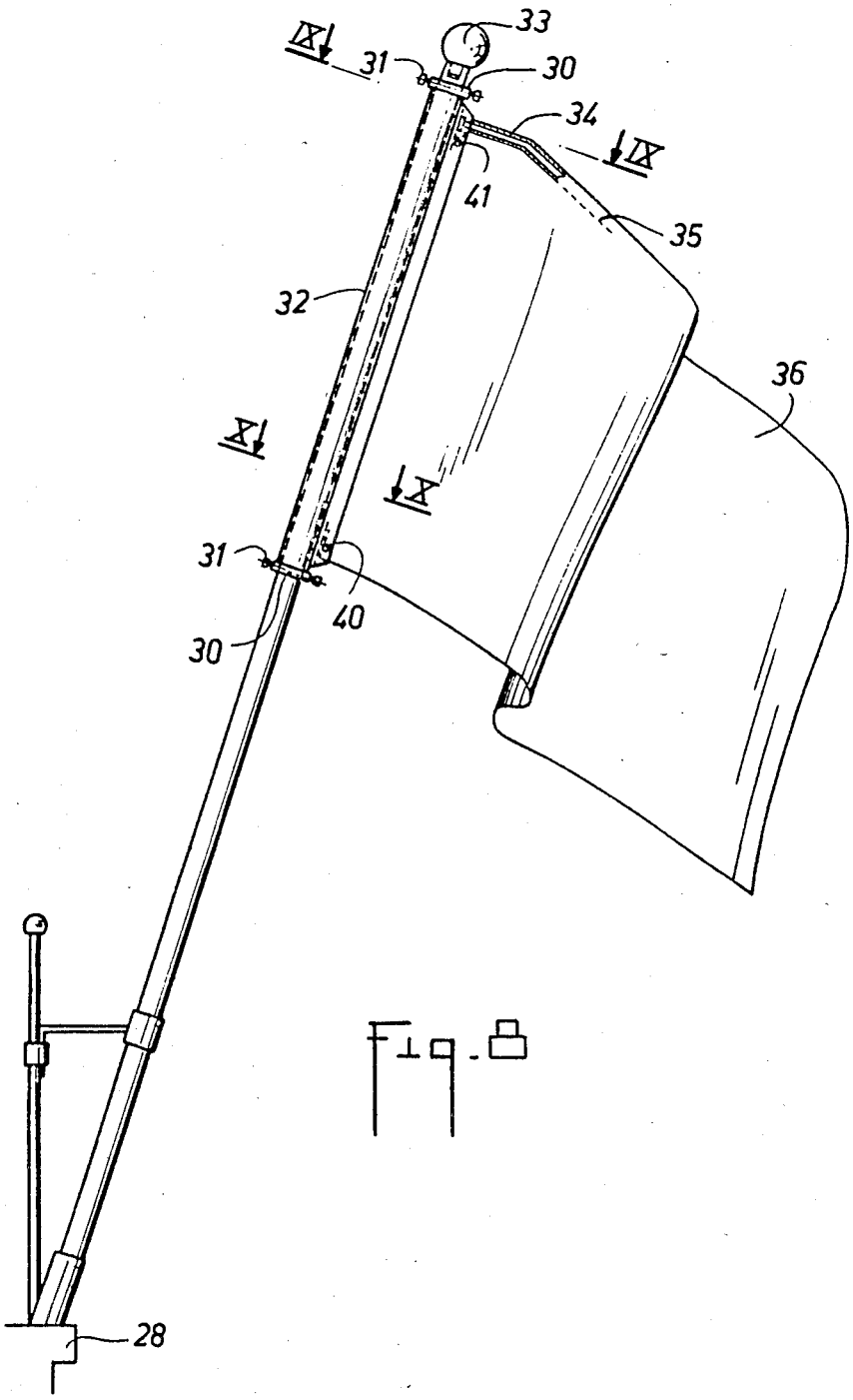
FIG. 8 shows a second embodiment of the invention.
Figure 10:
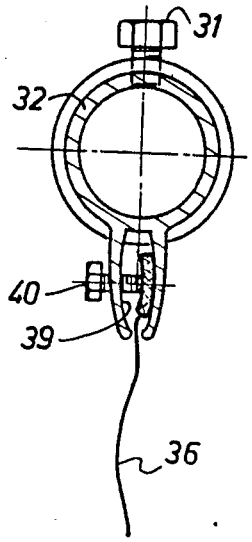
FIGS. 9 and 10 are views along IX—IX and X—X of FIG. 8, showing details of embodiment.

In FIG. 8 showing a cylindrical staff made of wood or the like, fixed to a balcony railing, the variant of the device of the invention is constituted by low and high shouldered rings 30 respectively fixable to the staff by screws 31, between the shoulders of which rings the sleeve 32 is maintained (the pommel 33 of the staff having, of course, prior to these operations, been unscrewed then re-assembled, if the sleeve and the rings are not dismountable).

Figure 9:
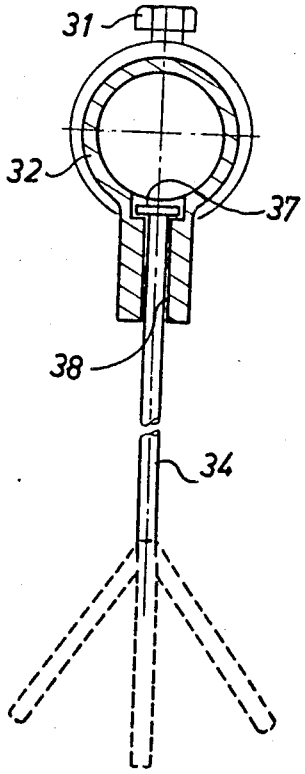

A metal rod 34 is threaded in the hem 35 of the flag 36, then its wider end 37 is placed in a radial housing 38 of the sleeve 32 (FIG. 9). The flag thus prepared is threaded in a slide 39 along the sleeve 32 and maintained taut in this slide by means of one or more locking screws 40, 41.

The metal rod 34, of round cross-section, is slightly bent to form an obtuse angle, and pivots in its housing 38 and is free inside the flag.

It is seen that this device allows one movement less than the preferred embodiment, namely the pivoting of the rod about an axis parallel to the staff.

It is obvious that numerous modifications may be made to the improved device for fastening a flag pivoting about its support, without departing from the scope of the present invention.

In fact, this embodiment is given by way of example. It may vary in shape and as a function of the manufacturing imperatives depending in particular on the material used, such as stainless metal, aluminium, nylon, plastics material, glass fiber or the like or depending on the use of roller bearings or the like, promoting the circular movement of the sleeve to which the flag is fastened. Self-lubricating plastics materials are obviously recommended.

The rod (tube and rod) is advantageously made of stainless steel, and its length is preferably close to one third of the length of the flag.

What is claimed is:

1. A device for fastening a flag on a staff via a sleeve coaxial to the staff mounted to rotate freely on the staff, the flag being able to exert on the sleeve, under the effect of the wind and/or the weight of the flag, a torque tending to rotate the sleeve and to avoid the flag winding therearound, wherein said device comprises a rod having two ends, a first end being connected to the sleeve so that the rod extends, at least partially, in a plane substantially transverse to the sleeve, the second end of the rod being remote from the sleeve and connected to the flag, whereby the torque exerted by the flag on the sleeve under the effect of the wind and/or of the weight of the flag is increased, and wherein the device further includes a means for retaining the sleeve on the staff, a lower ring and an upper ring for fastening the flag on the sleeve, the upper ring having a passage parallel to the staff for receiving a pivot part of the rod, the rod being constituted by a bent tube forming the pivot part and tubular extension part, and by a bent rod received in the tubular extension part.

2. The device of claim 1, wherein the rod is mounted to pivot about a pivot axis in a fixed relationship with respect to the sleeve.

3. The device of claim 2, wherein the pivot axis is parallel to the staff.

* * * * *